US010632601B2

(12) United States Patent
Pomeroy et al.

(10) Patent No.: US 10,632,601 B2
(45) Date of Patent: Apr. 28, 2020

(54) JAM RELEASE AND LIFTER MECHANISM FOR GAS SPRING FASTENER DRIVER

(71) Applicant: TTI (MACAO COMMERCIAL OFFSHORE) LIMITED, Macau (MO)

(72) Inventors: Edward Pomeroy, Piedmont, SC (US); Zachary Scott, Easley, SC (US); John Schnell, Anderson, SC (US); Essam Namouz, Greenville, SC (US)

(73) Assignee: TTI (MACAO COMMERCIAL OFFSHORE) LIMITED, Macau (MO)

( * ) Notice: Subject to any disclaimer, the term of this patent is extended or adjusted under 35 U.S.C. 154(b) by 239 days.

(21) Appl. No.: 15/807,714

(22) Filed: Nov. 9, 2017

(65) Prior Publication Data

US 2018/0126528 A1 May 10, 2018

Related U.S. Application Data

(60) Provisional application No. 62/419,605, filed on Nov. 9, 2016, provisional application No. 62/419,863, filed on Nov. 9, 2016.

(51) Int. Cl.
*B25C 1/06* (2006.01)
*B25C 1/04* (2006.01)
(Continued)

(52) U.S. Cl.
CPC ..... *B25C 1/047* (2013.01); *B25C 1/008* (2013.01); *B25C 1/04* (2013.01); *B25C 1/06* (2013.01); *B25C 5/13* (2013.01)

(58) Field of Classification Search
CPC ..... B25C 1/04; B25C 1/041; B25C 1/047; B25C 1/06; B25C 5/13
(Continued)

(56) References Cited

U.S. PATENT DOCUMENTS 4,215,808 A * 8/1980 Sollberger ..... B25C 1/041 173/204
4,834,278 A * 5/1989 Lin ..... B25C 1/06 227/131
(Continued)

FOREIGN PATENT DOCUMENTS

CN 105818099 A 8/2016
WO 2016199670 12/2016

OTHER PUBLICATIONS

Extended European Search Report for European Application No. 17200907.8, dated Apr. 5, 2018, 8 pages.

*Primary Examiner* — Scott A Smith
(74) *Attorney, Agent, or Firm* — Michael Best & Friedrich LLP

(57) ABSTRACT

A fastener driver comprises a driver blade movable from a retracted position to a driven position and a lifter assembly for moving the driver blade from the driven position toward the retracted position. The fastener driver also includes a first sensor to detect the driver blade in the driven position, a latch which, in a locked position, maintains the lifter assembly in an engaged position, an actuator coupled to the latch for moving the latch between the locked position and a released position, in which the lifter assembly may move away from the driver blade, and a controller electrically connected with the first sensor and the actuator. In response to an absence of a signal from the first sensor after a predetermined time following initiation of a fastener driving operation, the controller triggers the actuator to move the latch from the locked position to the released position.

30 Claims, 18 Drawing Sheets

(51) Int. Cl.
*B25C 5/13* (2006.01)
*B25C 1/00* (2006.01)

(58) Field of Classification Search
USPC ..... 227/130, 129, 2, 8, 132, 146, 131
See application file for complete search history.

(56) References Cited

U.S. PATENT DOCUMENTS 5,118,023 A * 6/1992 Fushiya ..... B25C 1/06 227/131
5,720,423 A * 2/1998 Kondo ..... B25C 1/04 227/130
5,927,585 A * 7/1999 Moorman ..... B25C 5/15 173/203
6,607,111 B2 * 8/2003 Garvis ..... B25C 1/06 173/124
7,152,774 B2 * 12/2006 Chen ..... B25C 1/06 227/131
7,201,303 B2 * 4/2007 Leimbach ..... B25C 1/06 227/120
8,011,441 B2 * 9/2011 Leimbach ..... B25C 1/047 173/1
8,393,512 B2 * 3/2013 Tanimoto ..... B25C 1/06 227/129
8,479,966 B2 * 7/2013 Chien ..... B25F 5/006 173/124
8,763,874 B2 * 7/2014 McCardle ..... B25C 1/047 227/129
8,875,969 B2 * 11/2014 Pedicini ..... B25C 1/04 227/10
9,868,196 B2 * 1/2018 Chien ..... B25C 1/047
2002/0104869 A1 * 8/2002 Garvis ..... B25C 1/06 227/138
2006/0180631 A1 * 8/2006 Pedicini ..... B25C 1/06 227/130
2007/0045377 A1 * 3/2007 Towfighi ..... B25C 1/04 227/130
2008/0017689 A1 * 1/2008 Simonelli ..... B25C 1/008 227/132
2008/0210736 A1 * 9/2008 Blessing ..... B25C 1/06 227/132
2011/0198381 A1 8/2011 McCardle et al.
2016/0096259 A1 4/2016 Pedicini
2016/0288305 A1 10/2016 McCardle et al.

* cited by examiner

JAM RELEASE AND LIFTER MECHANISM FOR GAS SPRING FASTENER DRIVER

CROSS-REFERENCE TO RELATED APPLICATIONS

This application claims priority to U.S. Provisional Patent Application Nos. 62/419,605 and 62/419,863, both filed on Nov. 9, 2016, the entire contents of which are incorporated herein by reference.

FIELD OF THE INVENTION

The present invention relates to powered fastener drivers, and more specifically to gas spring-powered fastener drivers.

BACKGROUND OF THE INVENTION

There are various fastener drivers known in the art for driving fasteners (e.g., nails, tacks, staples, etc.) into a workpiece. These fastener drivers operate utilizing various means known in the art (e.g. compressed air generated by an air compressor, electrical energy, a flywheel mechanism, etc.), but often these designs are met with power, size, and cost constraints.

SUMMARY OF THE INVENTION

The present invention provides, in one aspect, a fastener driver comprising a driver blade movable from a retracted position to an extended, driven position for driving a fastener into a workpiece, a gas spring mechanism for driving the driver blade from the retracted position to the driven position, and a lifter assembly for moving the driver blade from the driven position toward the retracted position. The fastener driver also includes a first sensor to detect the driver blade in the driven position, a latch which, in a locked position, maintains the lifter assembly in an engaged position for moving the driver blade from the driven position toward the retracted position, an actuator coupled to the latch for moving the latch between the locked position and a released position, in which the lifter assembly may move away from the driver blade, and a controller electrically connected with the first sensor and the actuator. In response to an absence of a signal from the first sensor after a predetermined time following initiation of a fastener driving operation, the controller triggers the actuator to move the latch from the locked position to the released position.

The present invention provides, in another aspect, a method of operating a fastener driver. The method comprises initiating a fastener driving operation by moving a driver blade from a retracted position toward a driven position, detecting that the driver blade has become jammed in an intermediate position between the retracted position and the driven position, moving a latch from a locked position, in which a lifter assembly is maintained in an engaged position for moving the driver blade from the driven position toward the retracted position, to a released position, in which the lifter assembly can move away from the driver blade, driving a motor to rotate a lifter of the lifting assembly, thereby moving the lifter assembly away from the driver blade, then, returning the lifter assembly to the engaged position, and moving the latch from the released position to the locked position.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
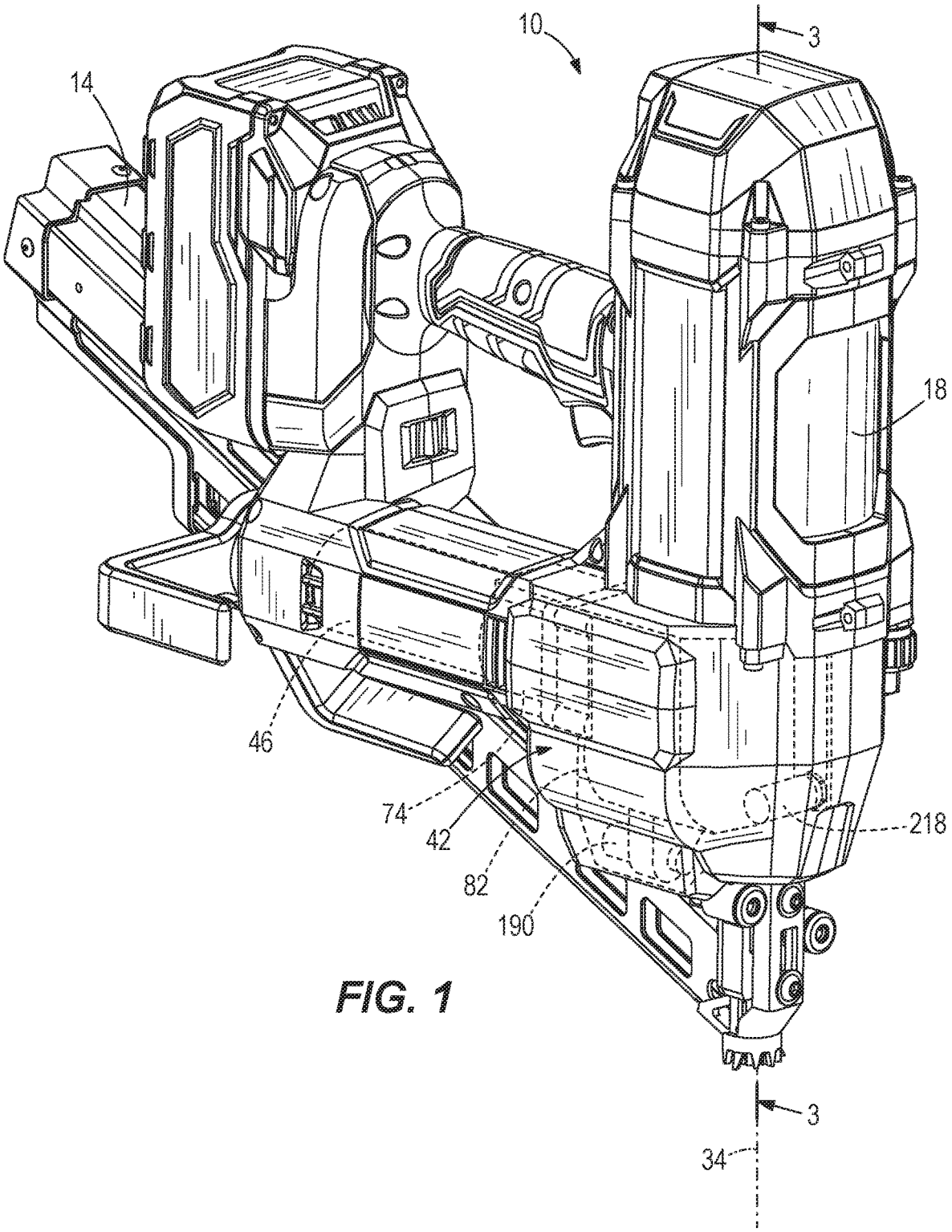
FIG. 1 is perspective view of a gas spring-powered fastener driver in accordance with an embodiment of the invention.
Figure 2:
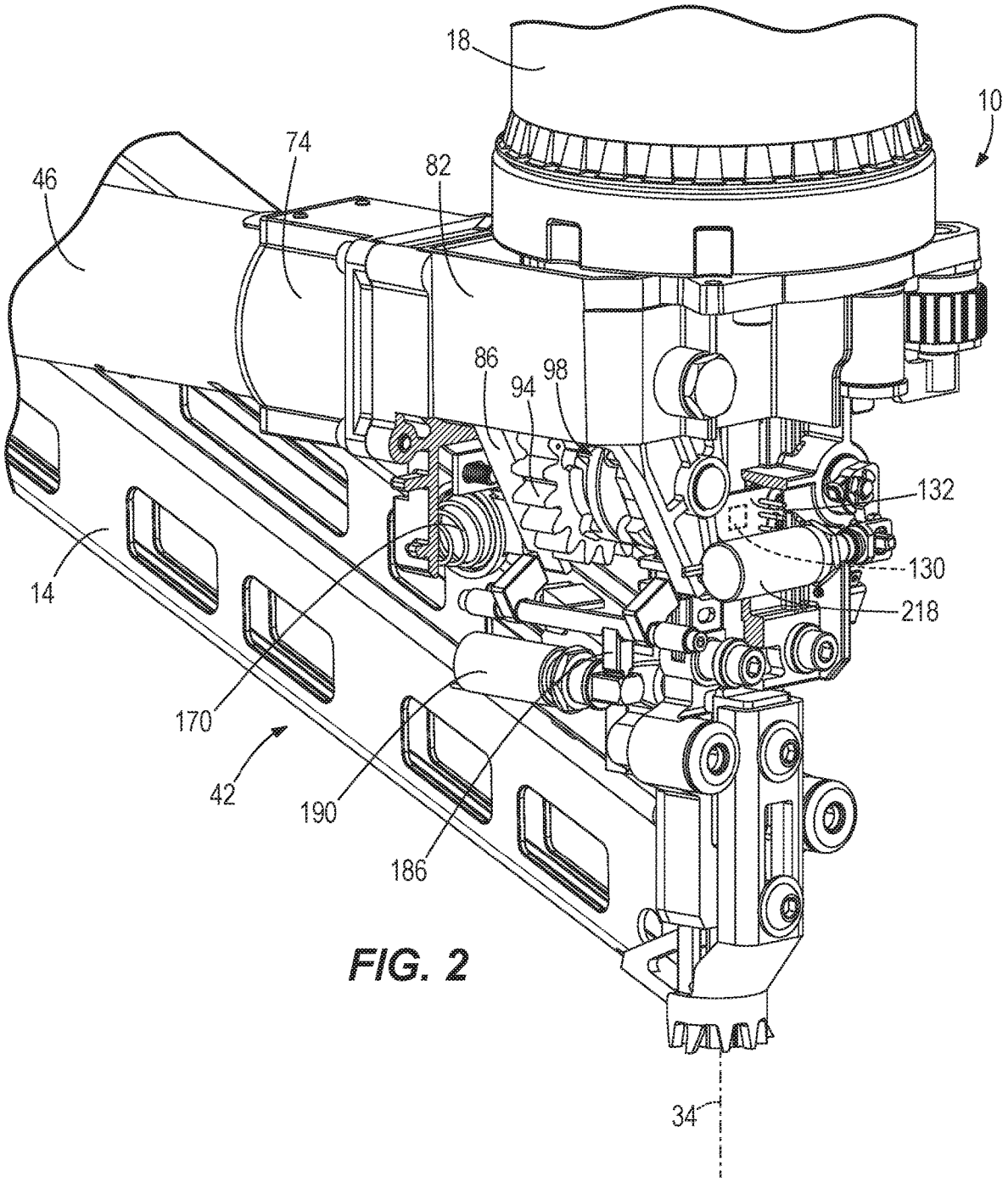
FIG. 2 is a partial perspective view of the gas spring-powered fastener driver of FIG. 1, with portions shown cut away for clarity.
Figure 3:
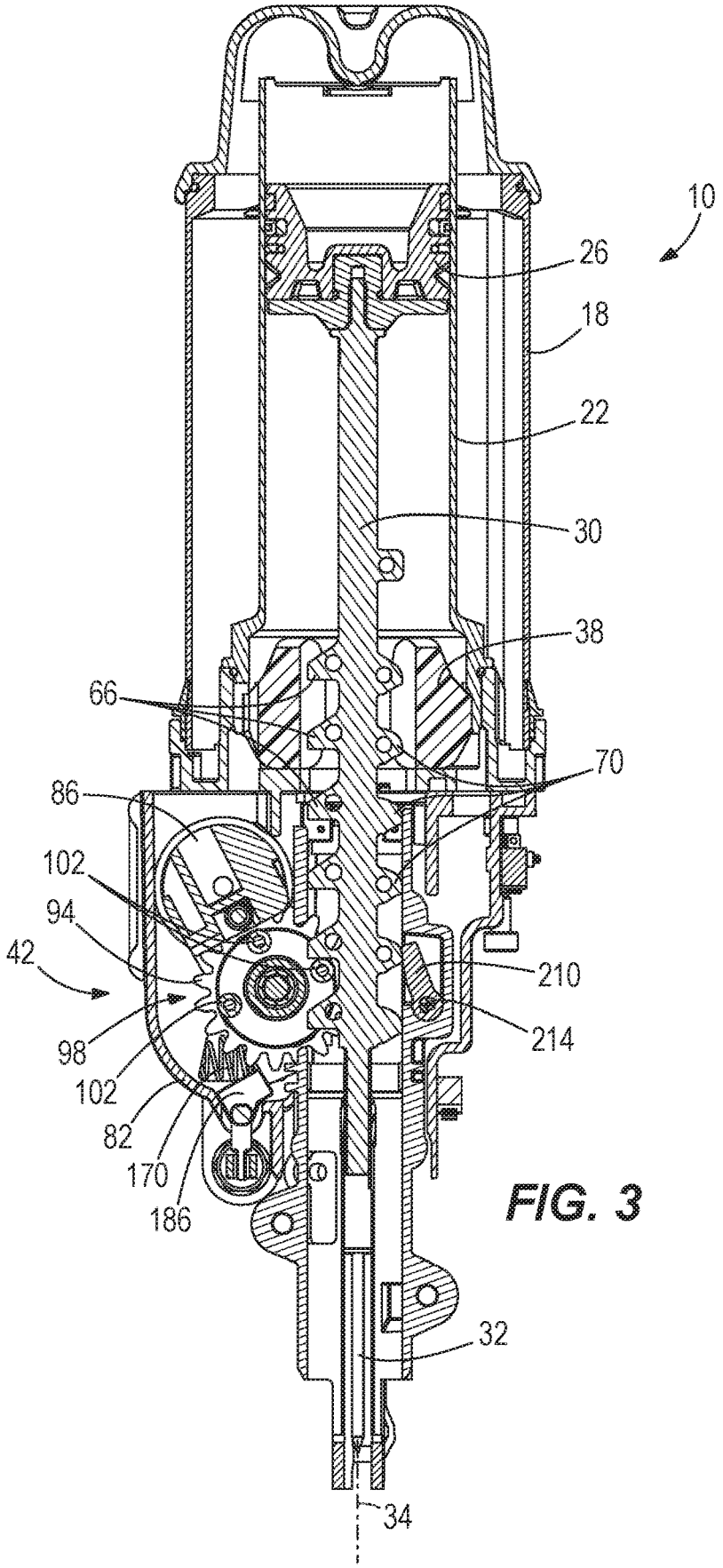
FIG. 3 is a cross-sectional view of the gas spring-powered fastener drive of FIG. 1 taken along lines 3-3 shown in FIG. 1.

With reference to FIGS. 1-3, a gas spring-powered fastener driver 10 is operable to drive fasteners (e.g., nails, tacks, staples, etc.) held within a magazine 14 into a workpiece. The fastener driver 10 includes an outer cylinder 18 and an inner cylinder 22 (FIG. 3) positioned within the outer cylinder 18. A moveable piston 26 is positioned within the inner cylinder 22 (FIG. 3). With reference to FIG. 3, the fastener driver 10 further includes a driver blade 30 that is attached to the piston 26 and moveable therewith. The fastener driver 10 does not require an external source of air pressure, but rather includes pressurized gas in the outer cylinder 18 that is in fluid communication with the inner cylinder 22. In the illustrated embodiment, the inner cylinder 22 and the moveable piston 26 are positioned within the outer cylinder 18.

Figure 12A:
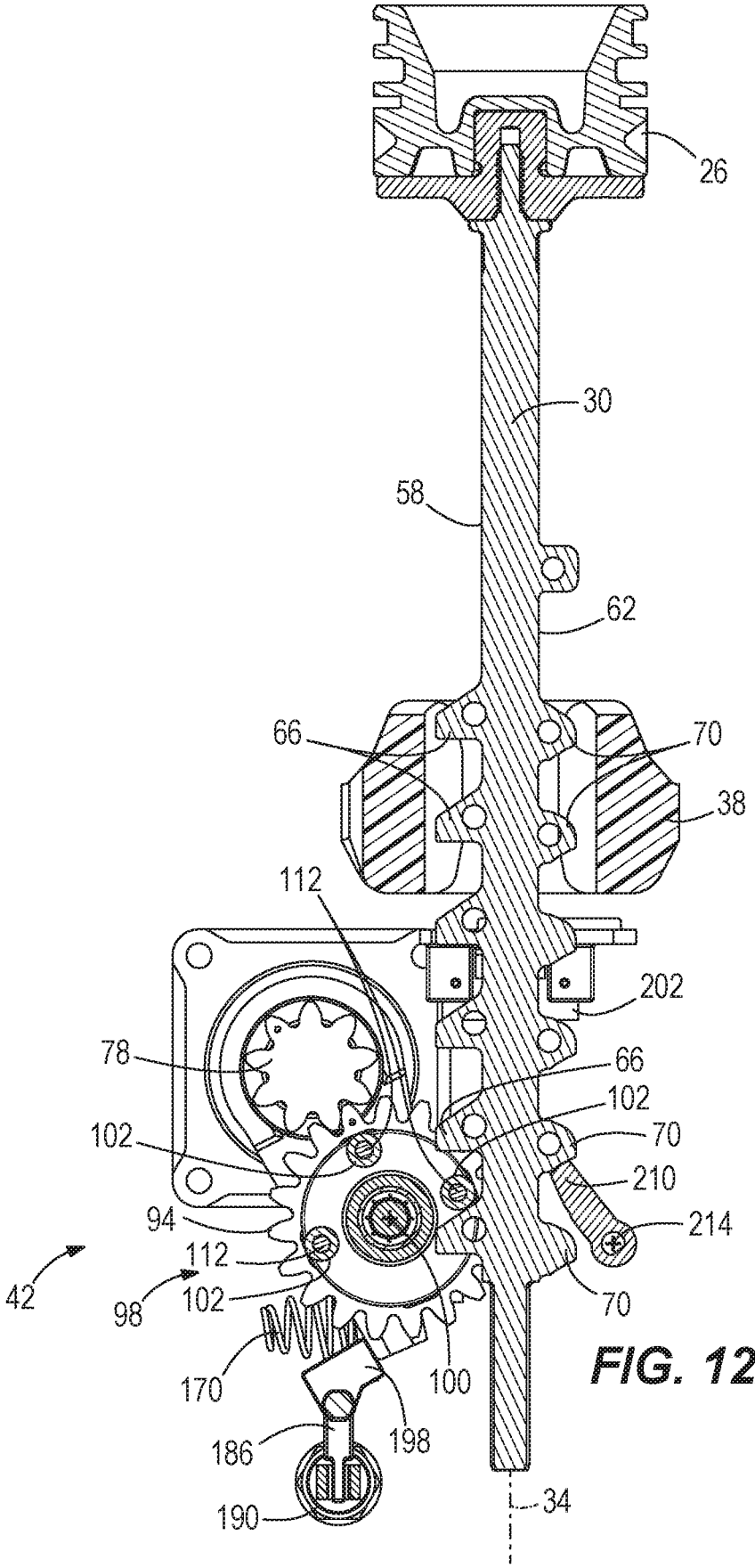
FIG. 12A is a cross-sectional view of the lifter assembly and the driver blade of FIG. 4, with portions removed for clarity, showing the driver blade in a ready position.
Figure 12B:
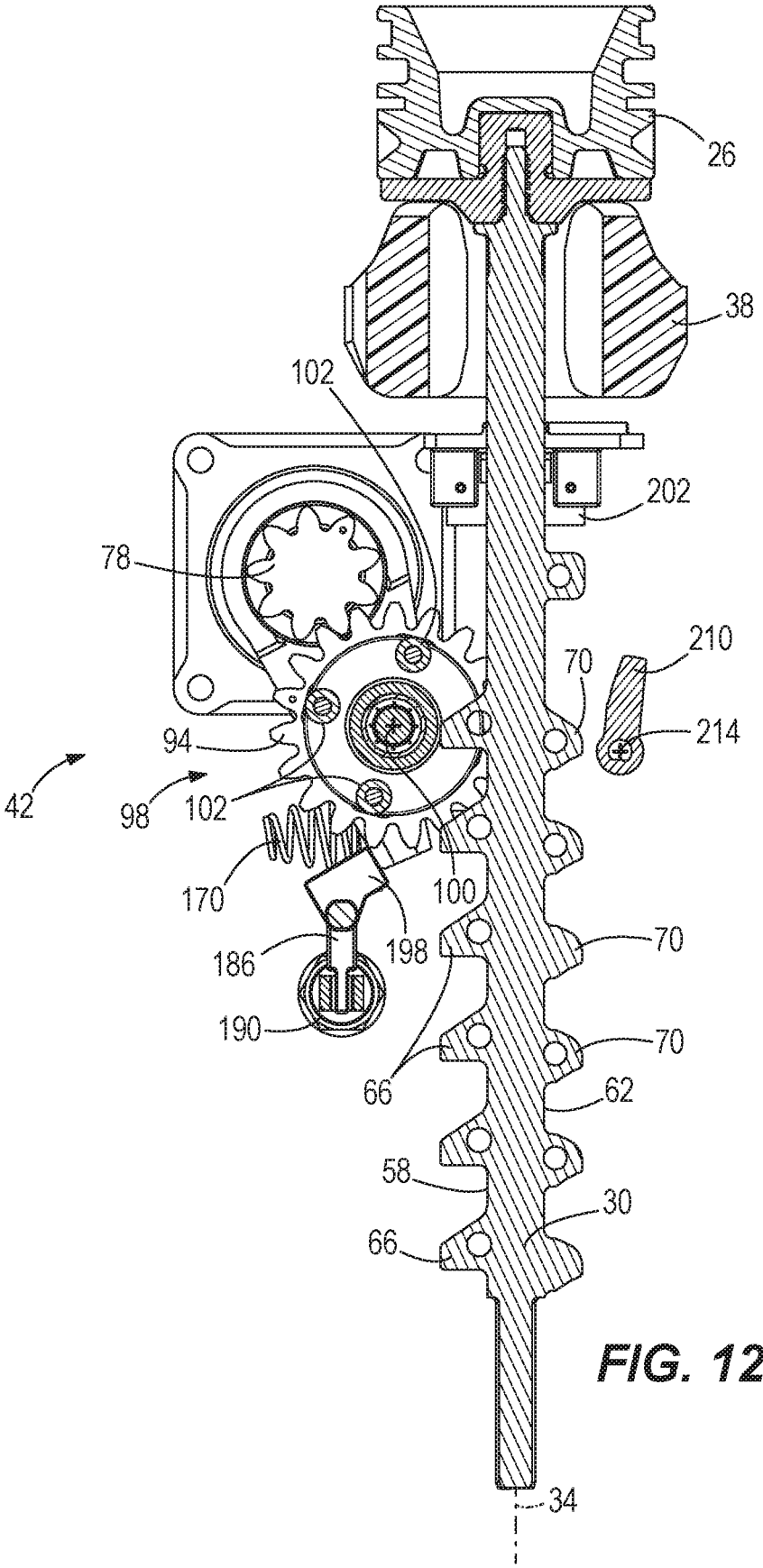
FIG. 12B is a cross-sectional view of the lifter assembly and the driver blade of FIG. 12A, showing the driver blade in a driven position.

With reference to FIG. 3, the inner cylinder 22 and the driver blade 30 define a driving axis 34, and during a driving cycle the driver blade 30 and piston 26 are moveable between a retracted, ready position (see FIG. 12A) and a driven position (i.e., bottom dead center; see FIG. 12B). The fastener driver 10 also includes a bumper 38 positioned beneath the piston 26 for stopping the piston 26 at the driven position and absorbing the impact energy from the piston 26. The fastener driver 10 further includes a lifter assembly 42, which is powered by a motor 46 (FIG. 1), and which is operable to move the driver blade 30 from the driven position to the ready position. As explained in greater detail below, the driver blade 30 may stop (e.g., become jammed) at an intermediate position (FIG. 12C) that is between the ready position and the driven position. In this situation, the lifter assembly 42 is also operable to move the driver blade 30 from the intermediate position to the ready position. A battery (not shown) is electrically connectable to the motor 46 for supplying electrical power to the motor 46. In alternative embodiments, the driver may be powered from an AC voltage input (i.e., from a wall outlet), or by an alternative DC voltage input (e.g., a DC power supply).

In operation, the lifter assembly 42 drives the piston 26 and the driver blade 30 to the ready position by energizing the motor 46. As the piston 26 and the driver blade 30 are driven to the ready position, the gas above the piston 26 and the gas within the outer cylinder 18 is compressed. Once in the ready position, the piston 26 and the driver blade 30 are held in position until released by user activation of a trigger (not shown). When released, the compressed gas above the piston 26 and within the outer cylinder 18 drives the piston 26 and the driver blade 30 to the driven position, thereby driving a fastener 32 (FIG. 3) into a workpiece. The illustrated fastener driver 10 therefore operates on a gas spring principle utilizing the lifter assembly 42 and the piston 26 to further compress the gas above the piston 26 within the inner cylinder 22 and the outer cylinder 18. Further detail regarding the structure and operation of the fastener driver 10 is provided below.

Figure 10:
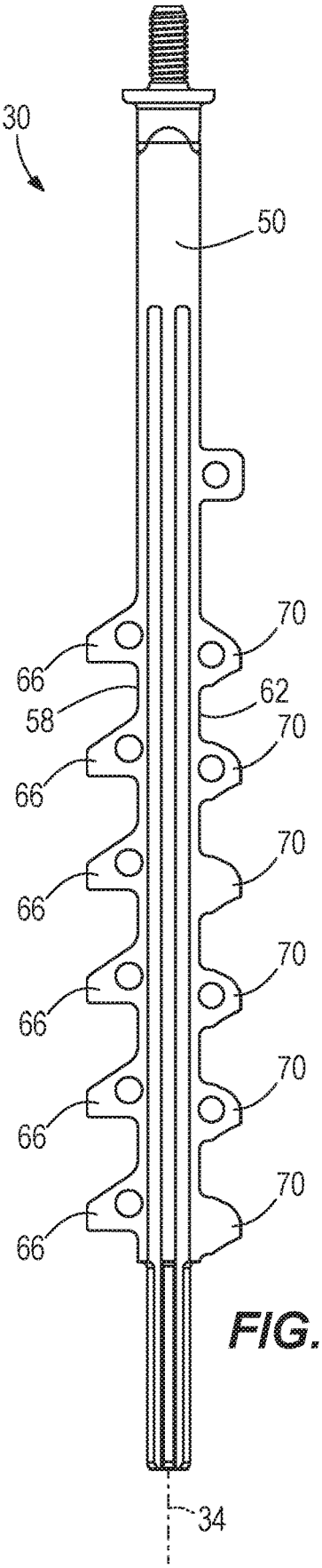
FIG. 10 is a front view of the driver blade of FIG. 4.
Figure 11:
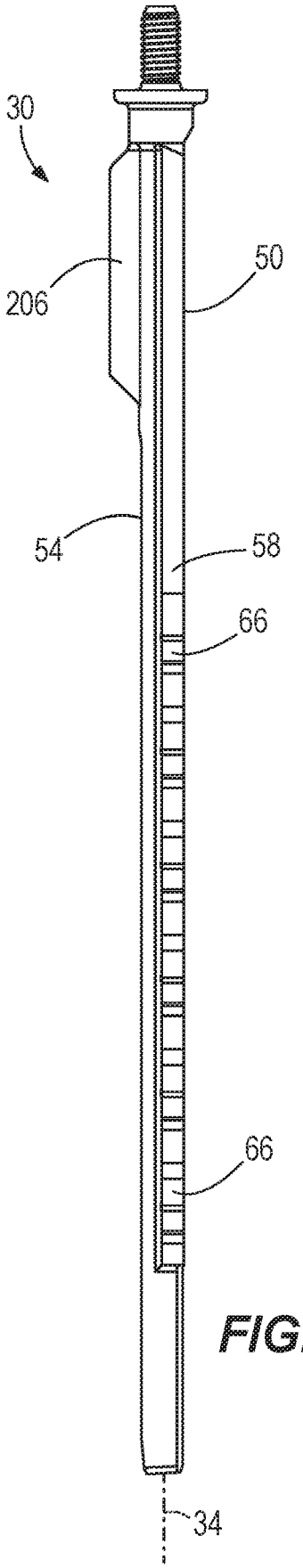
FIG. 11 is a side view of the driver blade of FIG. 10.

With reference to FIGS. 10-11, the driver blade 30 includes a first planar surface 50 (i.e., a front surface) and an opposite, second planar surface 54 (i.e., a rear surface). A first edge surface 58 extends between the first planar surface 50 and the second planar surface 54. In addition, a second edge surface 62 extends between the first planar surface 50 and the second planar surface 54. The first planar surface 50 is parallel to the second planar surface 54. As described earlier, the driver blade 30 defines the driving axis 34 along which it moves between the ready position and the driven position. The first edge surface 58 extends in the direction of the driving axis 34. In addition, the second edge surface 62 extends in the direction of the driving axis 34.

With continued reference to FIGS. 10-11, a plurality of lift teeth 66 are formed along the first edge surface 58. In addition, a plurality of latch teeth 70 are formed along the second edge surface 62. The lift teeth 66 project laterally from the first edge surface 58 relative to the driving axis 34. In addition, the latch teeth 70 project laterally from the second edge surface 62 relative to the driving axis 34. The lift teeth 66 are positioned on an opposite side of the driver blade 30 as the latch teeth 70. In other words, the driver blade 30 is flat and the lift teeth 66 and the latch teeth 70 are formed between the first planar surface 50 and the second planar surface 54. The lift teeth 66 and the latch teeth 70 do not extend in a direction transverse to the first planar surface 50 or the second planar surface 54. As described in greater detail below, positioning the lift teeth 66 on the side of the driver blade 30 is beneficial for improving the design of the lifter assembly 42.

Figure 4:
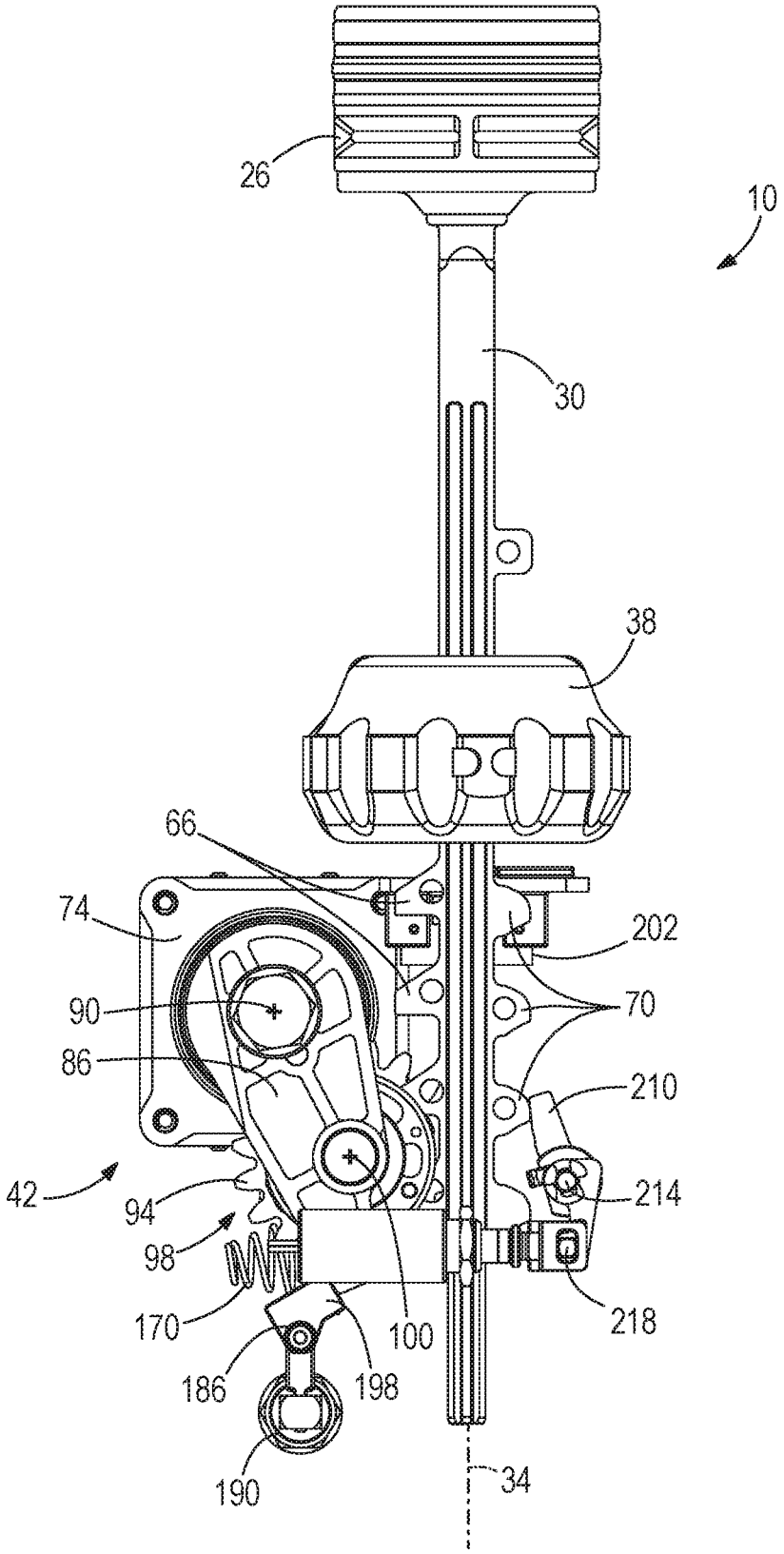
FIG. 4 is a front view of a lifter assembly and a driver blade for the gas spring-powered fastener driver of FIG. 1.
Figure 5:
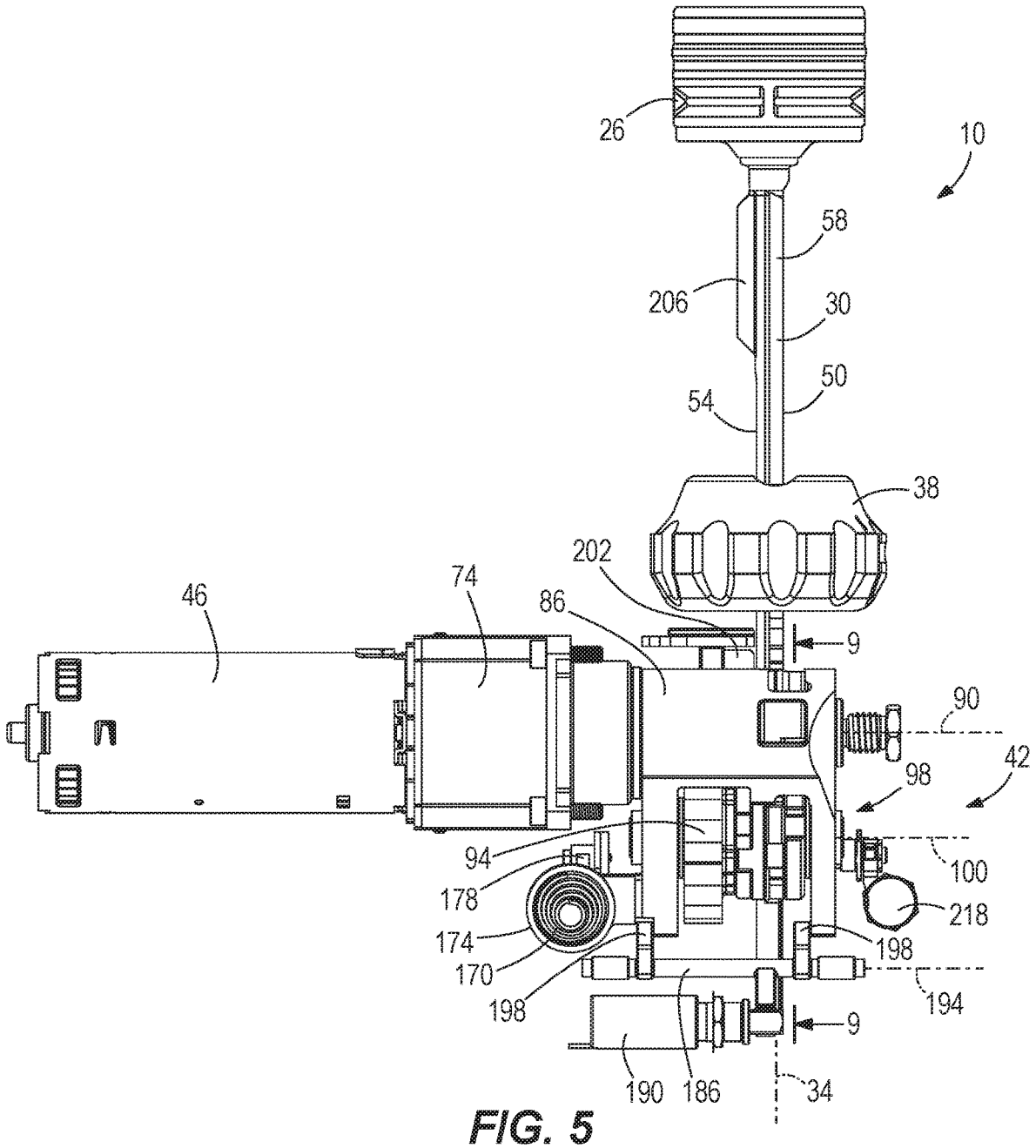
FIG. 5 is a side view of the lifter assembly and the driver blade of FIG. 4.
Figure 6:
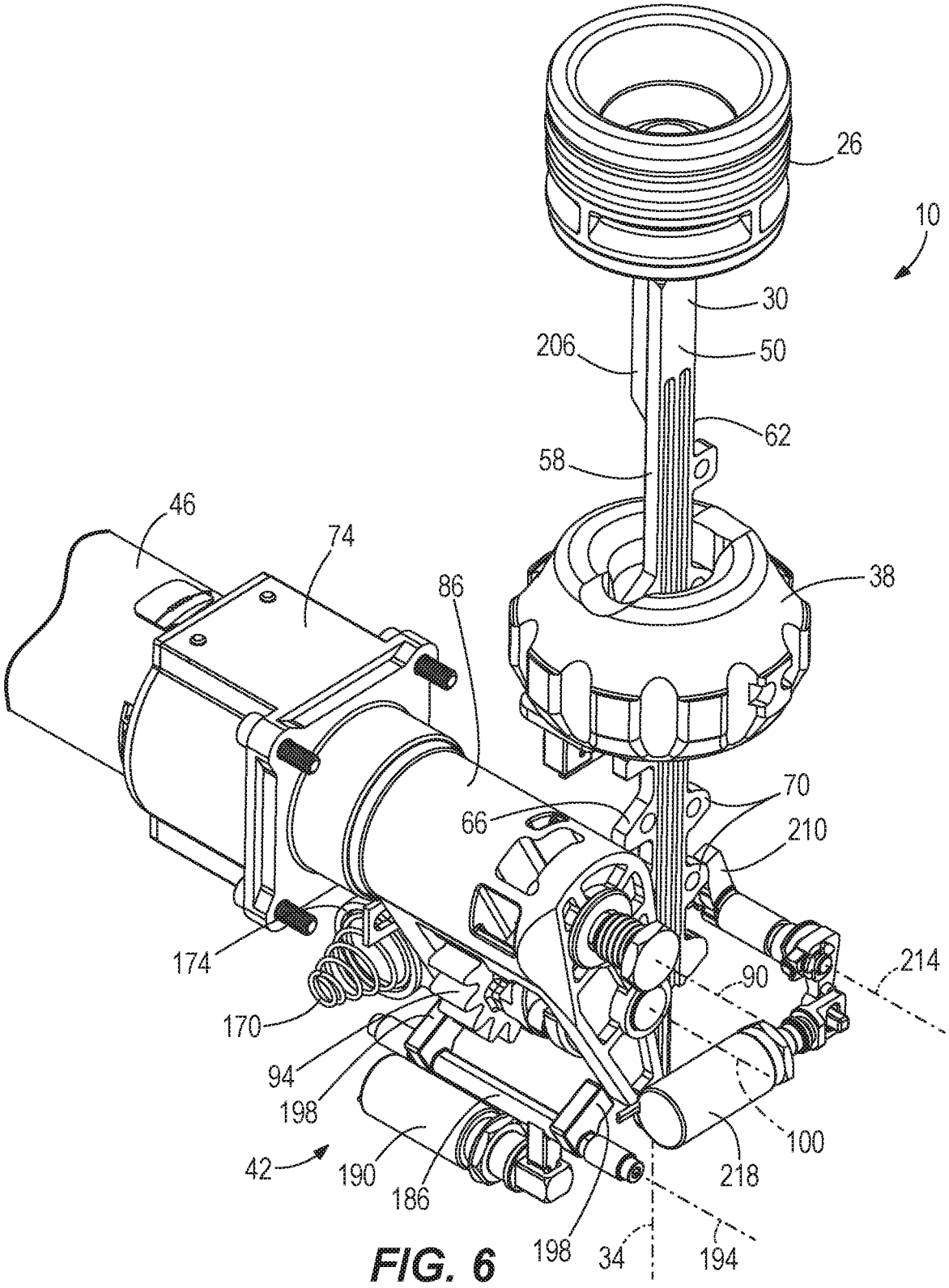
FIG. 6 is a top perspective view of the lifter assembly and the driver blade of FIG. 4.

With reference to FIGS. 4-6, the motor 46 is coupled to a gearbox or transmission 74 with an output pinion 78 (FIG. 12A). The transmission 74 is coupled to a housing 82 (FIG. 2), which contains at least a portion of the lifter assembly 42. The lifter assembly 42 includes a carrier 86 that is pivotally coupled to the transmission 74 about a pivot axis 90 (FIG. 5), which is coaxial with the output pinion 78 (FIG. 12A). The lifter assembly 42 also includes a pinion 94 that is supported on the carrier 86. The pinion 94 is enmeshed with the output pinion 78 of the transmission 74. The lifter assembly 42 further includes a lifter 98 that is supported on the carrier 86 and is drivingly coupled to the pinion 94. In particular, the lifter 98 is rotatable with respect to the carrier 86 about a lifter rotational axis 100. The lifter 98 includes three bearings 102 (FIG. 12A) that sequentially engage the lift teeth 66 formed on the driver blade 30 as the driver blade 30 is raised from the driven position toward the ready position. As such, power from the motor 46 is transferred through the transmission 74, through the pinions 78, 94, to the lifter 98, which engages the driver blade 30. In particular, the lifter 98 engages the lift teeth 66 to move the driver blade 30 from the driven position toward the ready position. More specifically, the bearings 102 of the lifter 98 engage the lift teeth 66 to move the driver blade 30 from the driven position to the ready position.

Figure 8:
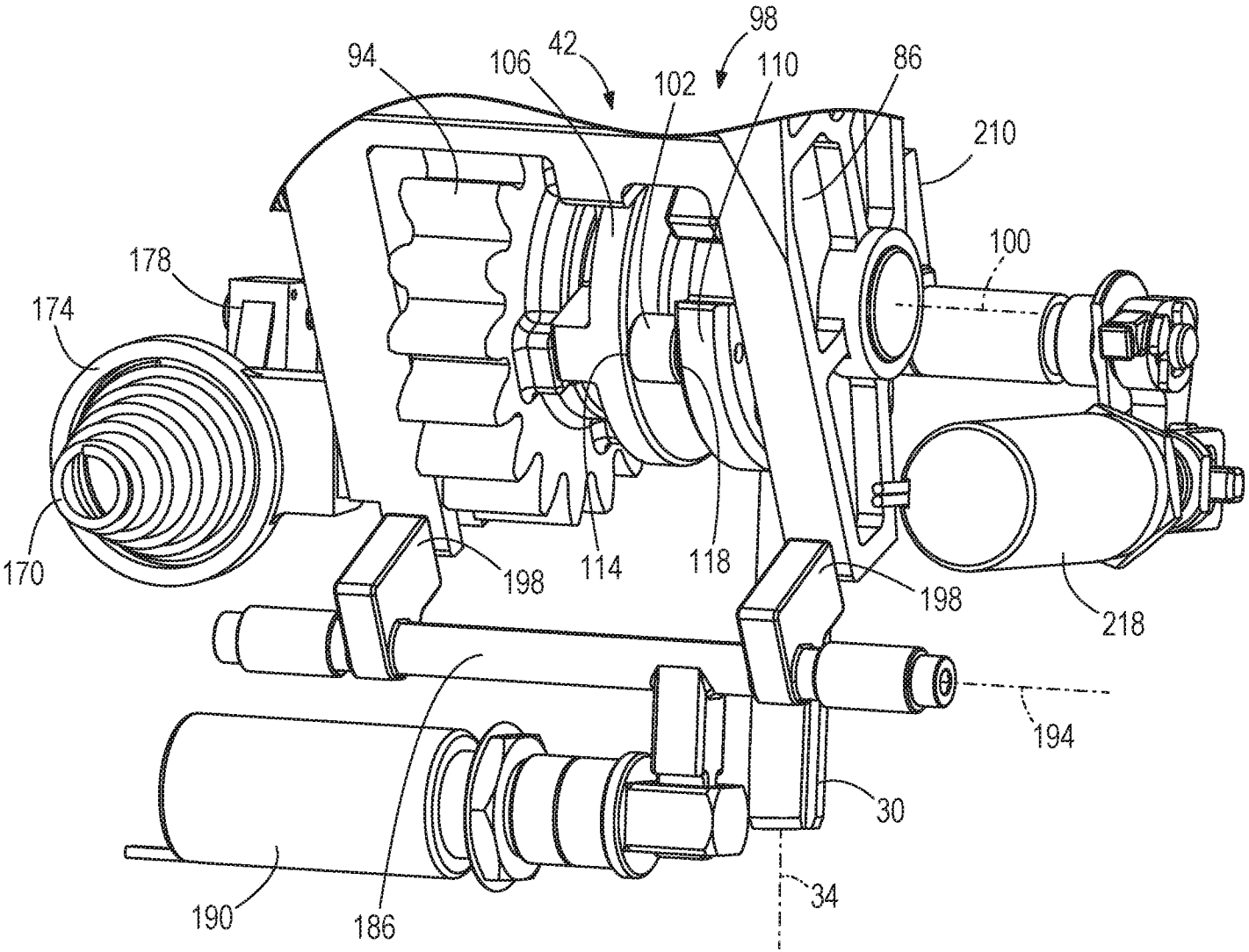
FIG. 8 is a side partial view of the lifter assembly of FIG. 4, showing a carrier lock in a locked state.
Figure 9:
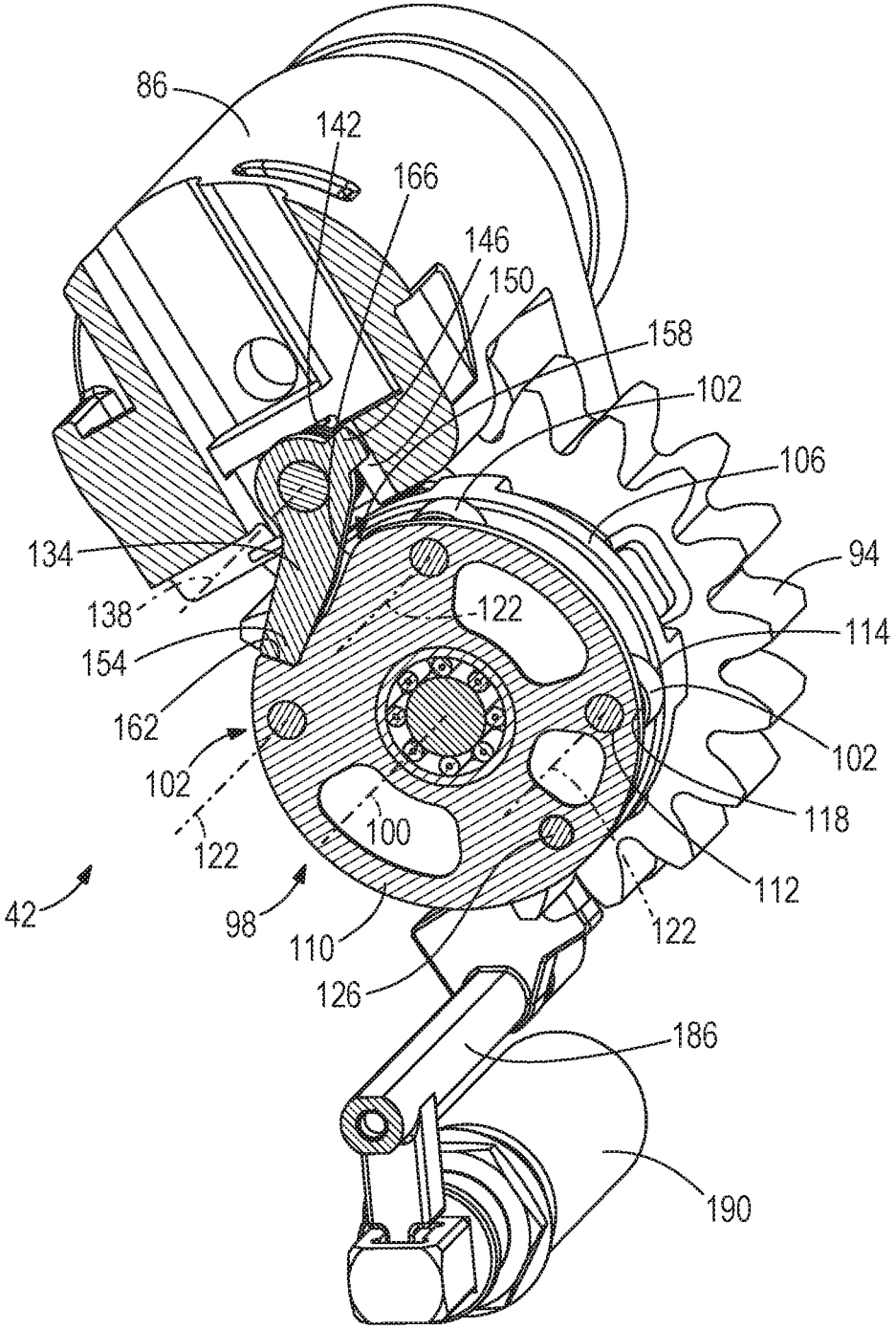
FIG. 9 is a cross-sectional view of the lifter assembly of FIG. 4, taken along lines 9-9 shown in FIG. 5, showing a ratchet in a blocking position.

With reference to FIGS. 8 and 9, the lifter 98 includes two support flanges 106, 110 with a pin 112 (FIG. 12A) extending therebetween to support both ends of the three bearings 102. Specifically, the bearings 102 each include a first end 114, a second end 118, and a bearing axis 122 extending between the first and second ends 114, 118. The pins 112 extend through the bearings 102 such that the bearings 102 are rotatably supported on the pins 112. The bearing axis 122 is transverse to the first planar surface 50 and the second planar surface 54 of the driver blade 30. In the illustrated embodiment, the bearing axis 122 is perpendicular to the first planar surface 50. In the illustrated embodiment, the bearing axis 122 is a rotational axis about which the bearings 102 rotate with respect to the support flanges 106, 110. Because the bearings 102 are capable of rotating relative to the lift teeth 66, sliding movement between the bearings 102 and the lift teeth 66 is inhibited when the lifter 98 is moving the driver blade 30 from the driven position toward the ready position. As a result, friction and attendant wear on the lift teeth 66 that might otherwise result from sliding movement between the bearings 102 and the lift teeth 66 is reduced.

The first support flange 106 is coupled to the first ends of the pins 112 proximate the first ends 114 of the bearings 102 and the second support flange 110 is coupled to the second ends of the pins 112 proximate the second ends 118 of the bearings 102. When engaged with the driver blade 30, the bearings 102 extend between the lift teeth 66 with the support flanges 106, 110 on either side of the lift teeth 66. As such, the pins 112 support the bearings 102 such that the bearings are supported on both ends 114, 118 and are not cantilevered. By supporting the bearings 102 on both end 114, 118, the bearings 102 can support larger loads. For example, the bearings 102 can lift the driver blade 30 against higher pressures when the bearings 102 are supported on both of their ends 114, 118.

With reference to FIG. 9, the lifter 98 includes a magnet 126 positioned in the support flange 110 that is detected by a corresponding sensor 130 (i.e., a driver blade home position sensor) mounted on a printed circuit board 132 (FIG. 2). The sensor 130 is a Hall-effect sensor operable to detect when the magnet 126 is in proximity to the sensor 130. When the lifter 98 is rotated such that the magnet 126 is aligned with the sensor 130, this orientation of the lifter 98 may be referred to as a home position coinciding with the ready position of the piston 26 and driver blade 30. The home position may be utilized for control purposes by a controller 136 (FIG. 13).

With reference to FIG. 9, the lifter assembly 42 further includes a ratchet 134 (i.e., a one-way mechanism) to prevent the motor 46 from being driven backwards. The ratchet 134 is pivotable about a pivot axis 138 and is biased by a torsion spring 142 into the position shown in FIG. 9. The ratchet 134 includes an upper arm 146 that is slidable within a slot 150 defined in the carrier 86 and a lower arm 154 that is engageable with the support flange 110. The support flange 110 includes a notch 158 partially defined by a flat surface 162 and a ramped surface 166. When the lifter 98 is rotated counterclockwise as viewed from FIG. 9 (i.e., the forward direction), the lower arm 154 of the ratchet 134 rides over the ramped surface 166 as the lifter 98 continues to rotate in the forward direction. When the lifter 98 rotates clockwise as viewed from FIG. 9 (i.e., the reverse direction), the lower arm 154 is pivoted into the notch 158 by the spring 142, thereby wedging the lower arm 154 against the flat surface 162 and preventing any further counterclockwise rotation of the lifter 98. With the ratchet 134 in the position shown in FIG. 9, the lifter 98 is prevented from further rotation in the clockwise direction (i.e., the reverse direction). As such, the ratchet 134 prevents the motor 46 from being rotated in a reverse rotational direction by, for example, the force applied to the driver blade 30 by the compressed gas above the piston 26. Said another way, the ratchet 134 permits a transfer of torque to the lifter 98 in a single (i.e., first) rotational direction, yet prevents the motor 46 from being driven in a reverse direction in response to an application of torque on the lifter 98 in an opposite, second rotational direction.

Figure 7:
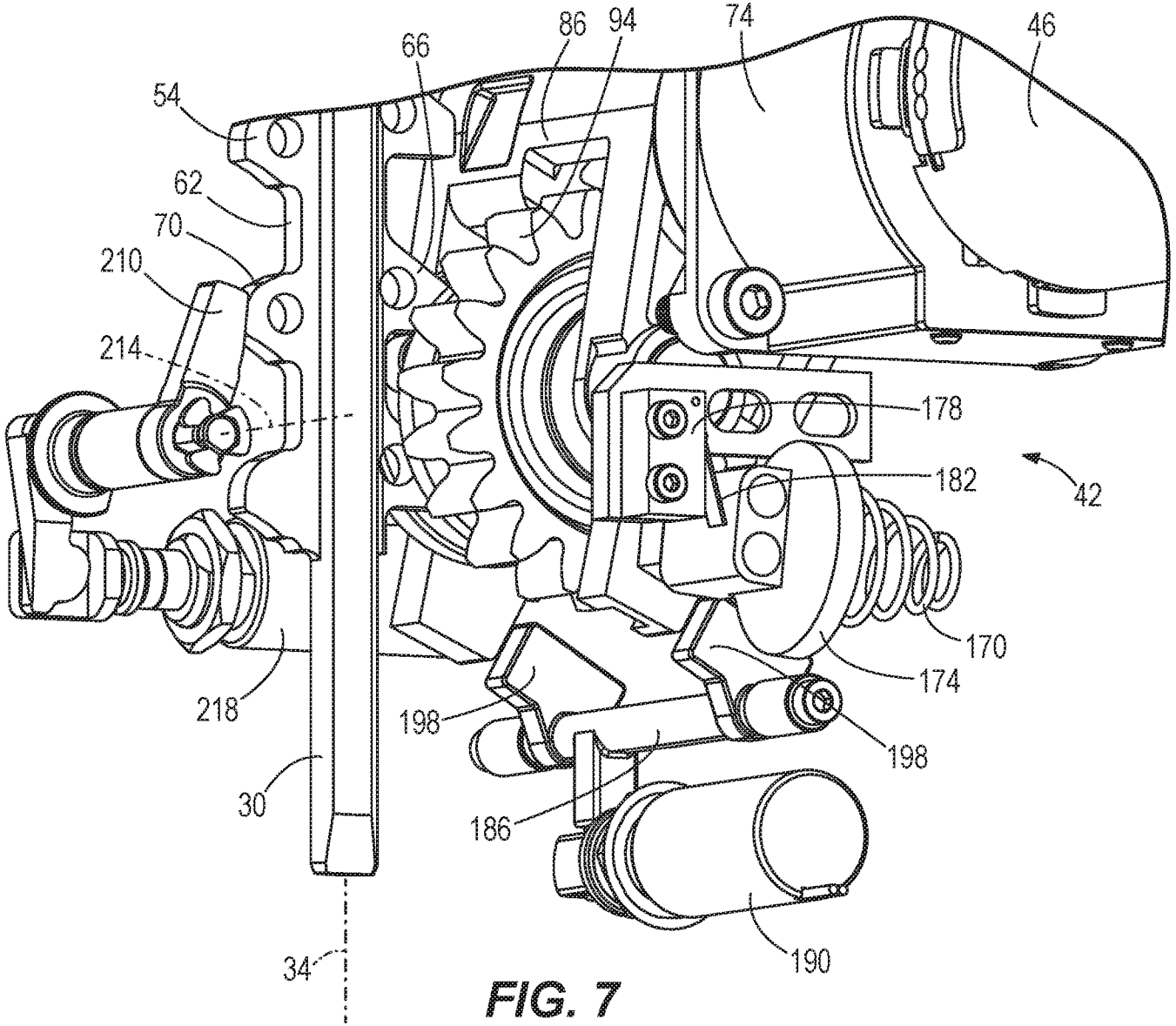
FIG. 7 is a rear partial view of the lifter assembly of FIG. 4, showing a carrier position switch.
Figure 12C:
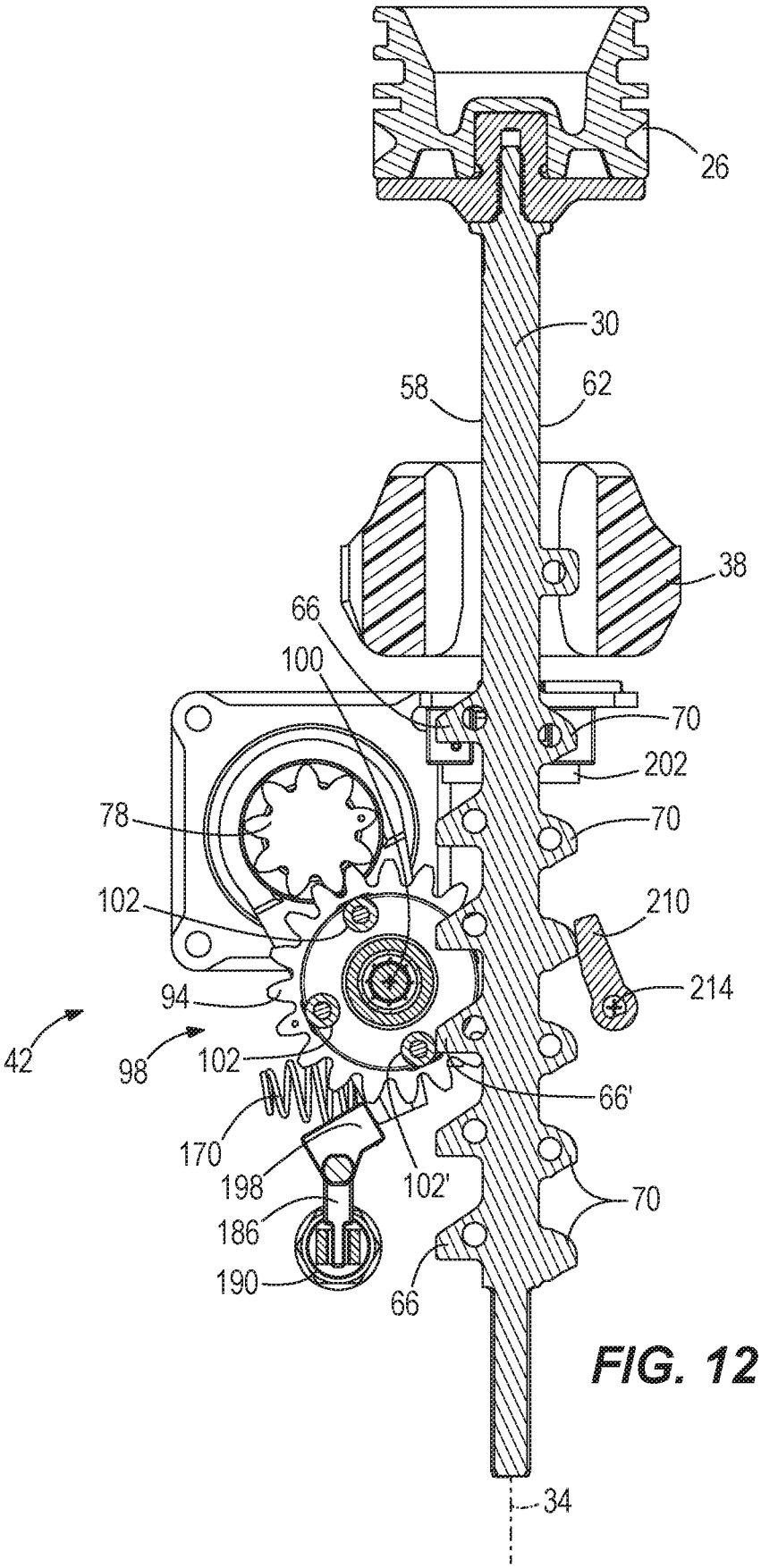
FIG. 12C is a cross-sectional view of the lifter assembly and the driver blade of FIG. 12A, showing the driver blade in an intermediate jam position.
Figure 12D:
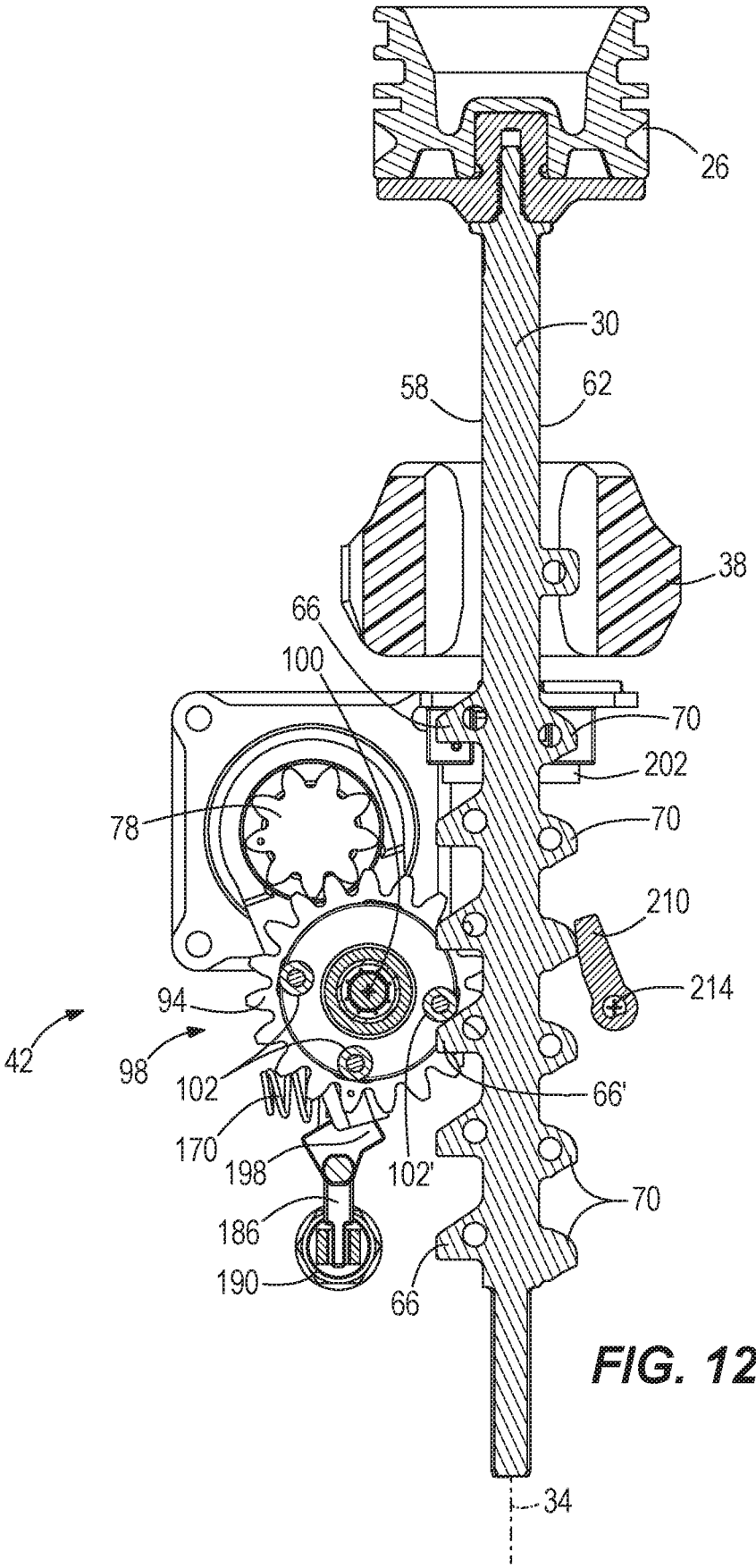
FIG. 12D is a cross-sectional view of the lifter assembly and the driver blade of FIG. 12A, showing the lifter assembly in a bypass position.

The lifter assembly 42 is moveable between an engaged position (e.g., FIGS. 12A and 12E) and a bypass position (e.g., FIG. 12D). In the bypass position, the lifter assembly 42 is pivoted about the pivot axis 90 away from the driver blade 30. In particular, the lifter assembly 42 moves away from the driver blade 30 when moving from the engaged position to the bypass position. As explained in greater detail below, when the driver blade 30 stops at the intermediate position (e.g., when a fastener jam occurs, see FIG. 12C), the lifter assembly 42 moves to the bypass position (FIG. 12D) before moving the driver blade 30 from the intermediate position to the ready position. With reference to FIGS. 2, 6, and 7, the carrier 86 is biased by a spring 170 to pivot about the pivot axis 90 towards the driver blade 30. In other words, the spring 170 biases the lifter assembly 42 towards the engaged position. In particular, a spring seat 174 is coupled to the carrier 86 and abuts against one end of the spring 170. The other end of the spring 170 abuts against an inner surface of the housing 82 (FIG. 2). A carrier position switch 178 (e.g., an electrical switch) is engageable with the carrier 86 (FIG. 7). Specifically, in the illustrated embodiment, a protrusion 182 of the spring seat 174 is positioned to engage and disengage the carrier position switch 178. As such, the carrier position switch 178 is operable to indicate whether the lifter assembly 42 is in the engaged position or the bypass position.

Figure 13:
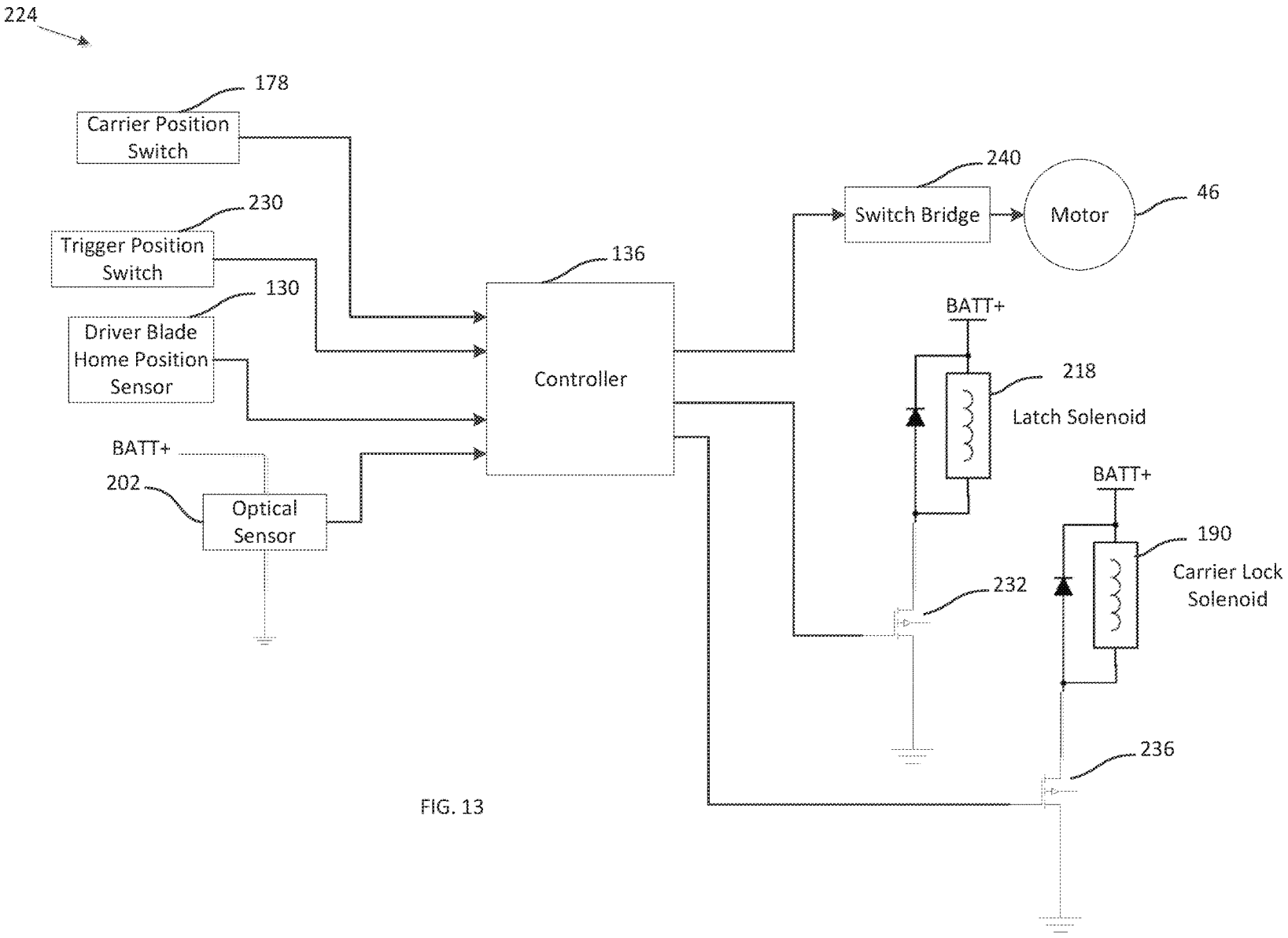
FIG. 13 is a schematic illustrating a control circuit of the gas-spring fastener driver of FIG. 1.

With reference to FIGS. 7 and 13, the carrier position switch 178 is operable to detect a position of the carrier 86. For example, the carrier position switch 178 may be an electro-mechanical switch (e.g., a normally closed micro-switch) that remains depressed or actuated during a normal fastener driving operation and the subsequent operation of the lifter assembly 42 to return the driver blade 30 to the ready position. The carrier position switch 178 provides a signal to the controller 136 (FIG. 13) indicating the position of the carrier 86. Specifically, the carrier position switch 178 indicates whether the carrier 86 is in a normal or home position in which the lifter 98 remains engaged with the driver blade 30 to raise the driver blade 30 toward the ready position, or the bypass position. In the bypass position, the carrier 86 is pivoted away from the driver blade 30 which, due to a fastener jam, is stuck in the intermediate position between the ready position and the driven position. When in the bypass position, the carrier position switch 178 is opened, providing a corresponding signal to the controller 136. Likewise, when in the normal or home position, the carrier position switch 178 is closed and provides a corresponding signal to the controller 136.

With reference to FIG. 12C, when the driver blade 30 is in the intermediate position, one of the lift teeth 66 (specifically, the tooth 66') is aligned with the bearing 102 (specifically, the bearing 102') of the lifter 98. If the driver blade 30 were stopped in the position shown in FIG. 12C, the lifter assembly 42 moves to the bypass position (FIG. 12D) to allow the bearing 102' to rotate pass the tooth 66' and to move back into alignment with the lift teeth 66. In other words, the lifter assembly 42 is moved to the bypass position to reposition the bearing 102' of the lifter 98 with respect to one of the lift teeth 66', effectively bypassing the lift tooth 66' and positioning the bearing 102' into the space above the tooth 66'.

With reference to FIGS. 5-8, the fastener driver 10 further includes a carrier lock 186 that is movable between a locked position (FIG. 8) and a released position (FIG. 5). The carrier lock 186 is selectively engageable with the carrier 86. Specifically, the carrier lock 186 holds the lifter assembly 42 in the engaged position when the carrier lock 186 is in the locked position, and the carrier lock 186 allows the lifter assembly 42 to move to the bypass position when the carrier lock 186 is in the released position. In the illustrated embodiment, the carrier lock 186 is moved to the released position when the driver blade 30 reaches the intermediate position, but does not reach the driven position (coinciding with the fastener 32 becoming jammed). In particular, a carrier lock solenoid 190 is energized and de-energized to translate the carrier lock 186 along an axis 194 between the locked position (FIG. 8) and the released position (FIG. 5). In the locked position (FIG. 8), protrusions 198 formed on the carrier lock 186 engage the carrier 86.

With reference to FIG. 5, the fastener driver 10 further includes a sensor 202 (e.g., an optical sensor) to determine when the driver blade 30 has reached the driven position. The sensor 202 is positioned proximate the driver blade 30 and includes an emitter to emit a light beam (e.g., a laser beam) and a receiver to receive the light beam. In the illustrated embodiment, the sensor 202 is an optical, laser sensor with a laser beam extending between two flanges. With reference to FIGS. 5 and 11, the driver blade 30 includes a flange 206 that is detected by the optical sensor 202 when the driver blade 30 has reached the driven position. In other words, the flange 206 on the driver blade 30 breaks the laser beam extending between the two flanges of the sensor 202, indicating the driver blade 30 has reached the driven position. Specifically, the sensor 202 detects the flange 206 near the top of the driver blade 30. When the driver blade 30 reaches the driven position, the flange 206 breaks or blocks the laser beam of the sensor 202 such that the receiver no longer receives the laser beam, providing a corresponding signal to the controller 136 that a successful fastener driving operation has been completed. However, if the controller 136 does not receive the signal within a predetermined period of time following initiation of the fastener driving operation, this suggests that the driver blade 30 is stuck in the intermediate position between the ready position and the drive position.

With reference to FIGS. 4-6, the fastener driver 10 further includes a latch 210 that engages the latch teeth 70 of the driver blade 30. Specifically, the latch 210 is spring biased to pivot about an axis 214 towards the latch teeth 70, toward a latched position. As such, the latch 210 rides along and over the latch teeth 70 as the driver blade 30 is moved from the driven position toward the ready position. In contrast, the latch 210 engages the latch teeth 70 to prevent the driver blade 30 from moving towards the driven position when the latch 210 is in a latched state. To release the latch 210, a latch solenoid 218 is selectively energized to pivot the latch 210 about the axis 214, away from the latch teeth 70, toward a released position. In other words, the latch 210 is moveable between a latched state in which the driver blade 30 is held in the ready position against a biasing force (i.e., the pressurized gas in the outer cylinder 18), and a released state in which the driver blade 30 is permitted to be driven by the biasing force from the ready position to the driven position. The latch solenoid 218 is energized and de-energized by the controller 136 to toggle the latch 210 between the released state and the latched state, respectively. In the illustrated embodiment, the latch 210 is spring biased against the latch teeth 70 at all times during use of the fastener driver 10 except for when the latch solenoid 218 is energized to move the latch 210 away from the driver blade 30 (FIG. 12B).

With reference to FIGS. 12A and 12B, normal operation of a firing cycle for the fastener driver 10 is illustrated and detailed below. With reference to FIG. 12A, prior to initiation of a firing cycle, the driver blade 30 is held in the ready position with the piston 26 within the inner cylinder 22. In the illustrated embodiment, the ready position is approximately 80 percent of the way up the inner cylinder (i.e., 80% of top-dead-center). In alternative embodiments, the ready position may be between approximately 70 and approximately 90 percent of top-dead center. In further alternatives, the ready position may be between approximately 50 and approximately 100 percent of top-dead-center. The latch 210 holds the driver blade 30 in the ready position. Holding the driver blade 30 in the ready position partially at top-dead-center improves cycle time by reducing the amount of time between when a user pulls the trigger and the fastener being driven.

With reference to FIG. 12B, upon the user of the fastener driver 10 pulling the trigger to initiate a firing cycle, the latch solenoid 218 is energized to pivot the latch 210 about the axis 214 from the position shown in FIG. 12A to the position shown in FIG. 12B, thereby removing the latch 218 from the latch teeth 70 in the driver blade 30 (i.e., the released state of the latch 210). Thereafter, the piston 26 and the driver blade 30 are thrust downward toward the driven position (FIG. 12B) by the expanding gas in the outer cylinder 18 and in the inner cylinder 22 above the piston 26. As the driver blade 30 is displaced toward the driven position, the motor 46 remains activated to continue counter-clockwise rotation of the lifter 98. In some embodiments, the lifter assembly 42 may raise the driver blade 30 pass the ready position towards top-dead-center (while or after the latch 210 has been pivoted to the released state) before the bearings 102 slip off the lower-most lift tooth 66. In other words, in alternative embodiments, the driver blade 30 may be released directly from the ready position by releasing the latch 218, or may be raised further pass the ready position toward top-dead-center before being released by both the latch 218 and the bearings 102 being in an unobstructed position with respect to the driver blade 30.

Upon a fastener being driven into a workpiece, the piston 26 impacts the bumper 38 to quickly decelerate the piston 26 and the driver blade 30, eventually stopping the piston 26 in the driven or bottom dead center position. As the driver blade 30 reaches the driven position, the flange 206 is detected by the optical sensor 202, indicating the driver blade 30 has successfully reached the driven position. Shortly after the driver blade 30 reaches the driven position, one of the bearings 102 on the lifter 98 engages one of the lift teeth 66 on the driver blade 30, and continued rotation of the lifter 98 raises the driver blade 30 and the piston 26 toward the ready position. Shortly thereafter and prior to the lifter 98 making one complete rotation, the latch solenoid 218 is de-energized, permitting the latch 210 to re-engage the driver blade 30 and ratchet into and out of the latch teeth 70 as upward displacement of the driver blade 30 continues (i.e., the latched state of the latch 210). In the illustrated embodiment, more than one rotation of the lifter 98 is required to move the driver blade 30 from the driven position to the ready position. In particular, it takes two complete rotations of the lifter 98 to move the driver blade 30 from the driven position to the ready position in the illustrated embodiment.

Figure 12E:
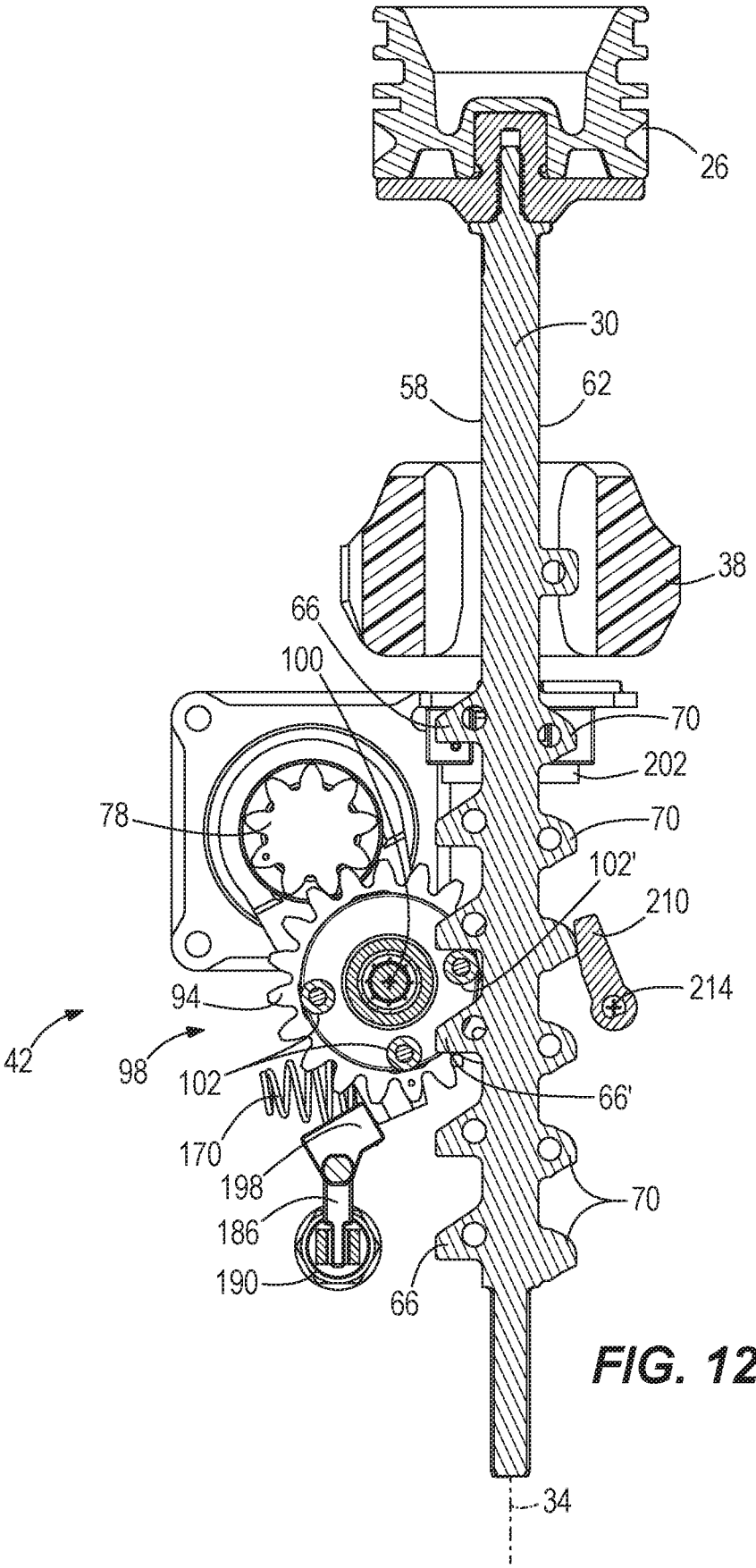
FIG. 12E is a cross-sectional view of the lifter assembly and the driver blade of FIG. 12A, showing the lifter assembly in an engaged position.

With reference to FIGS. 12C, 12D, and 12E, jam release operation for the fastener driver 10 is illustrated and detailed below. With reference to FIG. 12C, the driver blade 30 may stop or become jammed at an intermediate position between the ready and driven position if the fastener 32 buckles during a fastener driving operation. The optical sensor 202 is operable to determine when the driver blade 30 does not reach the driven position but rather is stopped at an intermediate position. With the driver blade 30 in an intermediate position, the bearings 102 on the lifter 98 may be blocked by the lift teeth 66 (FIG. 12C), depending on the exact position at which the driver blade 30 stops. In other words, the driver blade 30 may stop at an intermediate position in which the lift teeth 66 are blocking the bearings 102 from reentering the space between the lift teeth 66.

With reference to FIG. 12D, when the beam of the optical sensor 202 isn't tripped by the flange 206 on the driver blade 30 within a predetermined period of time following initiation of the fastener driving operation (thereby coinciding with the driver blade 30 becoming jammed in the intermediate position), the carrier lock solenoid 190 is energized to move the carrier lock 186 from the locked position to the released position. Once the carrier lock 186 is in the released position, the lifter assembly 42 is able to move to the bypass position (FIG. 12D). In particular, the carrier 86 moves with respect to the driver blade 30 when the carrier lock 186 is in the released position and the motor 46 continues to rotate the lifter 98. In addition, the lifter 98 moves with the carrier 86 about the pivot axis 90. In other words, continued rotation of the motor 46 drives the lifter assembly 42 to the bypass position such that the bearing 102' may rotate past and slide along the blocking tooth 66' (see the transition from FIG. 12C to 12D). Said another way, the rotational axis 100 of the lifter 98 moves away from the driver blade 30 to allow the blocked bearing 102' to move past the blocking tooth 66'.

As the bearing 102' rotates past the blocking tooth 66' and the bearing 102' is capable of reentering the space between the tooth 66' and an adjacent tooth 66, the spring 170 biases the lifter assembly 42 back into the engaged position (FIG. 12E). Once the lifter assembly 42 has re-entered the engaged position (FIG. 12E), the lifter 98 may resume rotation to raise the driver blade 30 from the intermediate position to the ready position. In addition, once the lifter assembly 42 has re-entered the engaged position, the carrier position switch 178 is actuated to indicate that the lifter assembly 42 has returned to the engaged position. With the lifter assembly 42 back in the engaged position, the carrier lock solenoid 190 is de-energized and the carrier lock 186 is moved back to the locked position to secure the carrier 86 in the engaged position.

FIG. 13 illustrates a schematic of a control circuit 224 for controlling the operation of the fastener driver 10. As described above, the controller 136 receives inputs from the sensor 130 (i.e., the driver blade home position sensor), the carrier position switch 178, the sensor 202, and a trigger position switch 230 (which may also include a workpiece contact element switch). Using these inputs, the controller 136 provides control signals to the motor 46, the carrier lock solenoid 190, and the latch solenoid 218 to operate the fastener driver 10. In some embodiments, the controller 136 is implemented as a microprocessor with separate memory. In other embodiments, the controller 136 is a microcontroller (with memory on the same chip). In other embodiments, the controller 136 may be implemented using multiple processors.

The sensor 202 is connected to the battery, for example, through a voltage regulator (not shown) and receives operating power from the battery. The sensor 202 provides a data output to the controller 136 indicating whether or not the driver blade 30 has reached the driven position.

The latch solenoid 218 is also connected to the battery, for example, through a voltage regulator (not shown) and receives operating power from the battery. The latch solenoid 218 is connected to ground through a latch solenoid control switch 232 (e.g., a FET). The controller 136 provides a control signal (i.e., a latch control output) to the latch solenoid control switch 232 to energize and de-energize the latch solenoid 218. When the controller 136 closes the latch solenoid control switch 232, current flows through the latch solenoid 218 thereby energizing the latch solenoid 218. When the controller 136 opens the latch solenoid control switch 232, the latch solenoid 218 is de-energized and returns to a biased state (e.g., using a spring). The controller 136 controls the latch solenoid control switch 232 based on an input received from the trigger position switch 230 as described below.

The carrier lock solenoid 190 is also connected to the battery, for example, through a voltage regulator (not shown) and receives operating power from the battery. The carrier lock solenoid 190 is connected to ground through a carrier lock solenoid control switch 236 (e.g., a FET). The controller 136 provides a control signal (i.e., a carrier lock control output) to the carrier lock solenoid control switch 236 to energize and de-energize the carrier lock solenoid 190. When the controller 136 closes the carrier lock solenoid control switch 236, current flows through the carrier lock solenoid 190 thereby energizing the carrier lock solenoid 190. When the controller 136 opens the carrier lock solenoid control switch 236, the carrier lock solenoid 190 is de-energized and returns to a biased state (e.g., using a spring). The controller 136 controls the carrier lock solenoid control switch 236 based on input received from the sensor 202 and the carrier position switch 178 as described below.

The controller 136 further controls the motor 46 through a switch bridge 240. The controller 136 provides control signals to the switch bridge 240 based on inputs received from the trigger position switch 230 and the sensor 130 (i.e., the driver blade home position sensor) as described below. The motor 46 receives operating power from the battery through the switch bridge 240.

Figure 14:
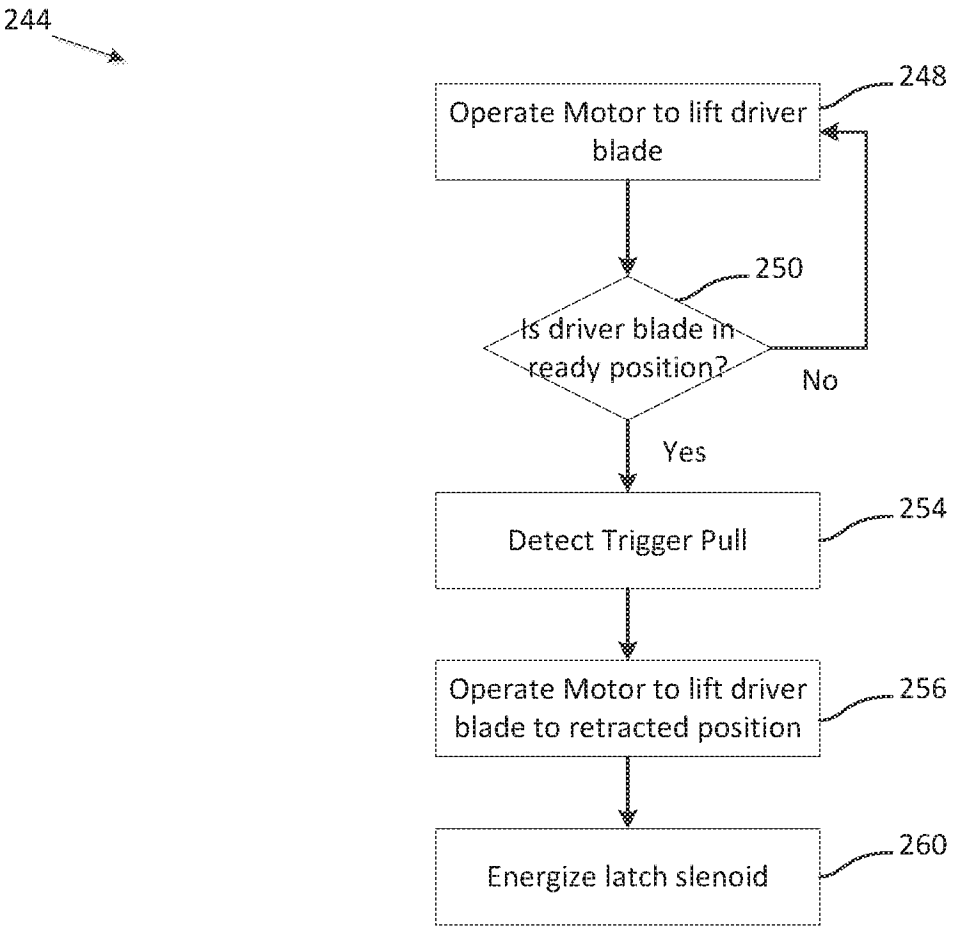
FIG. 14 is a flowchart illustrating a method of operating the lifter assembly of FIG. 4.

FIG. 14 is a flowchart illustrating one example method 244 of operating the fastener driver 10 following a successful fastener driving operation (i.e., with the driver blade 30 in the driven position). The method 244 includes operating the motor 46 to lift the driver blade 30 to the ready position (at step 248). In some embodiments, the ready position may be lower than the fully retracted position of the driver blade 30. For example, the ready position may be between 50-90% of the fully retracted or top-dead-center position of the piston 26 and driver blade 30. At step 250, the controller 136 determines whether the driver blade 30 is in the ready position using input from the sensor 130 (i.e., the driver blade home position sensor) and continues to operate the motor 46 until the driver blade 30 is in the ready position, coinciding with the sensor 130 detecting the magnet 126 on the lifter 98. The controller 136 may control the motor 46 to perform a predetermined number of rotations to lift the driver blade 30 to the ready position. For example, the controller 136 may control the motor 46 to perform two revolutions of the lifter 98 in order to return the driver blade 30 to the ready position.

At step 254, the controller 136 detects a trigger actuation using input from the trigger position switch 230. The controller 136 may be in a standby state until the trigger actuation is detected. When the trigger is actuated, the controller 136 may operate the motor 46 to lift the driver blade 30 to the fully retracted or top-dead-center position at step 256. Shortly thereafter, at step 260, the controller 136 energizes the latch solenoid 218 to pivot the latch 210 away from the driver blade 30 where it cannot interfere with movement of the driver blade 30 from the fully retracted or top-dead-center position to the driven position. The compressed gas above the piston 26 and within the outer cylinder 18 then drives the piston 26 and the driver blade 30 to the driven position, thereby driving a fastener into a workpiece.

Figure 15:
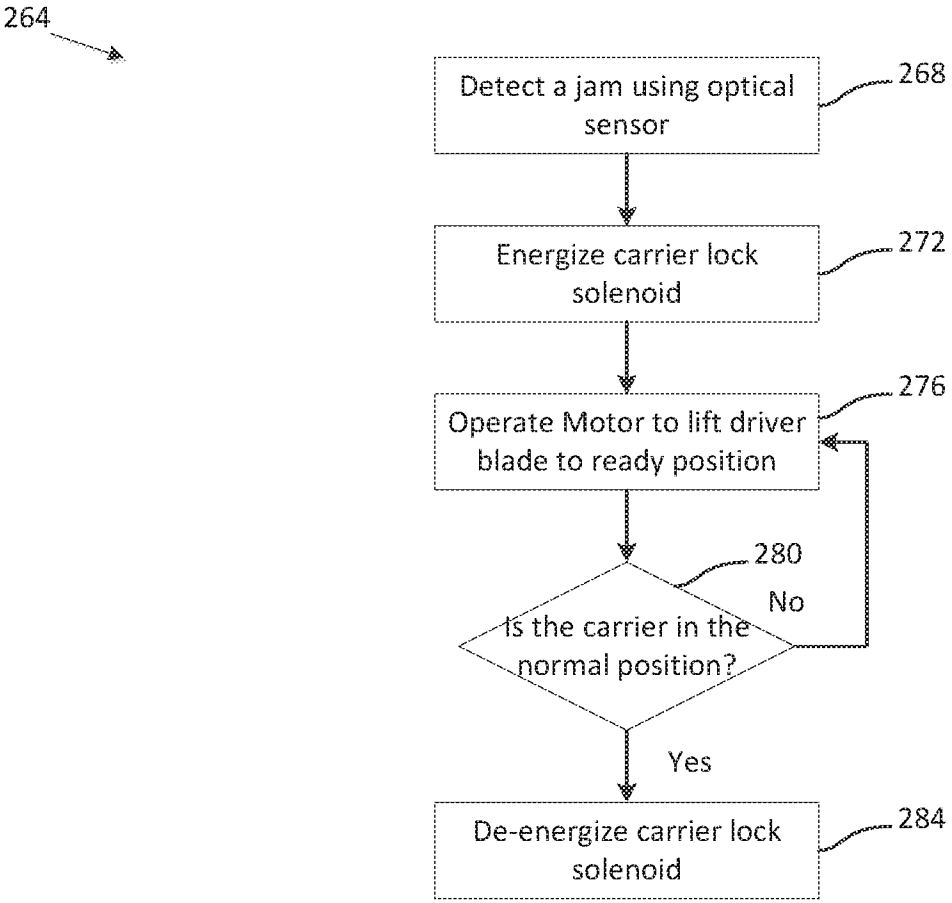
FIG. 15 is a flowchart illustrating a method of releasing a jam in the gas-spring fastener driver of FIG. 1.

FIG. 15 is a flowchart illustrating one example method 264 of operating the fastener driver 10 to clear a jam. The method 264 includes detecting a jam using the sensor 202 (at step 268). As described above, the sensor 202 indicates that the fastener driver 10 is jammed when the light beam of the sensor 202 is not broken or blocked by the flange 206 on the driver blade 30, meaning that the driver blade 30 is stuck between the retracted (i.e., ready) position and the driven position. Thereafter, at step 272, the controller 136 energizes the carrier lock solenoid 190 to move the carrier lock 186 to the released position, which allows the carrier 86 to move to the bypass position as the motor 46 continues to rotate.

At step 276, the controller 136 continues to operate the motor 46 to lift the driver blade 30 from the intermediate position to the ready position. In the intermediate position of the driver blade 30, one of the bearings 102 may be prevented from being received between adjacent teeth on the driver blade 30 to return the driver blade 30 to the ready position (as shown in FIG. 12C). In this situation, with the carrier lock 186 released, the carrier 86 may move to the bypass position to allow one of the bearings 102 to slide between adjacent lift teeth 66 on the driver blade 30 (FIG. 12D). As the carrier 86 moves to the bypass position, the carrier position switch 178 is opened, indicating to the controller 136 that the carrier 86 is in the bypass position.

At step 280, using input from the carrier position switch 178, the controller 136 determines whether the carrier 86 has returned to its normal or home position. The carrier 86 returns to the normal position as the bearings 102 properly engage the lift teeth 66 on the driver blade 30 to raise the driver blade 30 toward the ready position. When the carrier position switch 178 is closed (i.e., indicating that the carrier 86 has returned to its normal or home position), the controller 136 de-energizes the carrier lock solenoid 190 (at step 284). As described above, when the carrier lock solenoid 190 is de-energized, the carrier lock 186 returns to the lock position blocking the movement of the carrier 86 from the normal position.

As such, the lifter assembly 42 is operable to automatically return the driver blade 30 to the ready position when a jam occurs and the driver blade 30 does not reach the driven position. With the driver blade 30 automatically returned to the ready position, the jammed fastener may be cleared more easily.

Various features of the invention are set forth in the following claims.

What is claimed is:

1. A fastener driver comprising:

a driver blade movable from a retracted position to an extended, driven position for driving a fastener into a workpiece;

a gas spring mechanism for driving the driver blade from the retracted position to the driven position;

a lifter assembly for moving the driver blade from the driven position toward the retracted position;

a first sensor to detect the driver blade in the driven position;

a latch which, in a locked position, maintains the lifter assembly in an engaged position for moving the driver blade from the driven position toward the retracted position;

an actuator coupled to the latch for moving the latch between the locked position and a released position, in which the lifter assembly is movable away from the driver blade; and a controller electrically connected with the first sensor and the actuator, wherein, in response to an absence of a signal from the first sensor after a predetermined time following initiation of a fastener driving operation, the controller triggers the actuator to move the latch from the locked position to the released position.

2. The fastener driver of claim 1, wherein the lifter assembly is moveable from the engaged position toward a bypass position when the latch is in the released position.

3. The fastener driver of claim 2, wherein the lifter assembly moves to the bypass position before moving the driver blade from an intermediate position between the retracted position and the extended position toward the retracted position.

4. The fastener driver of claim 2, wherein the lifter assembly moves away from the driver blade when moving from the engaged position to the bypass position.

5. The fastener driver of claim 2, wherein a spring biases the lifter assembly towards the engaged position.

6. The fastener driver of claim 2, further comprising a motor, wherein the lifter assembly includes a carrier and a lifter rotatably supported on the carrier, and wherein the lifter is driven by the motor to selectively engage the driver blade.

7. The fastener driver of claim 6, wherein the latch is engageable with the carrier when in the locked position.

8. The fastener driver of claim 7, wherein the latch is moved to the released position in response to detection of the fastener jam.

9. The fastener driver of claim 8, wherein the carrier moves with respect to the driver blade when the latch is in the released position and as the motor rotates the lifter.

10. The fastener driver of claim 6, wherein the lifter assembly further includes a ratchet to prevent the motor from being rotated in a reverse rotational direction.

11. The fastener driver of claim 6, further comprising an electrical switch engageable with the carrier and operable to indicate when the lifter assembly is in the bypass position.

12. The fastener driver of claim 6, wherein the driver blade includes a plurality of teeth and the lifter includes at least one bearing engageable with the plurality of teeth.

13. The fastener driver of claim 12, wherein when the driver blade is in an intermediate position between the retracted position and the driven position, one of the plurality of teeth is aligned with the at least one bearing of the lifter.

14. The fastener driver of claim 13, wherein the lifter assembly is moved to the bypass position to reposition the bearing of the lifter with respect to the one of the plurality of teeth.

15. The fastener driver of claim 6, further comprising a transmission having an output pinion, wherein the lifter assembly includes an input pinion meshed with the output pinion, and wherein the input pinion is drivably coupled to the lifter for rotating the lifter in response to activation of the motor.

16. The fastener driver of claim 15, wherein the lifter assembly is pivotable between the engaged position and the bypass position about an axis that is coaxial with the output pinion of the transmission.

17. The fastener driver of claim 1, further comprising a sensor to determine when the driver blade has reached the driven position.

18. The fastener driver of claim 17, wherein the sensor is an optical sensor.

19. The fastener driver of claim 18, wherein the driver blade includes a flange that is detected by the optical sensor when the driver blade has reached the driven position.

20. The fastener driver of claim 1, wherein the driver blade includes a first planar surface, a second planar surface, a first edge surface extending between the first planar surface and the second planar surface, and a plurality of teeth projecting laterally from the first edge surface relative to the driving axis.

21. The fastener driver of claim 20, wherein the first planar surface is parallel to the second planar surface.

22. The fastener driver of claim 20, wherein the first edge surface extends in the direction of the driving axis.

23. The fastener driver of claim 20, wherein the lifter engages the plurality of teeth to move the driver blade from the driven position to the retracted position.

24. The fastener driver of claim 23, wherein the lifter includes a bearing that selectively engages the plurality of teeth to move the driver blade towards the retracted position.

25. The fastener driver of claim 24, wherein the bearing includes a first end, a second end, and an axis extending between the first end and second end, wherein the axis is transverse to the first planar surface and the second planar surface.

26. The fastener driver of claim 25, wherein the lifter further includes a first support coupled to the first end of the bearing and a second support coupled to the second end of the bearing.

27. The fastener driver of claim 24, wherein the plurality of teeth is a first plurality of teeth and wherein the driver blade further includes a second edge surface extending between the first planar surface and the second planar surface and a second plurality of teeth projecting laterally from the second edge surface relative to the driving axis.

28. The fastener driver of claim 27, wherein the latch is a first latch, and wherein the fastener driver further comprises a second latch that engages the second plurality of teeth to prevent the driver blade from moving towards the driven position.

29. The fastener driver of claim 1, wherein the lifter assembly includes a carrier and a lifter rotatably supported on the carrier, wherein the lifter is engageable with the driver blade when the lifter assembly is in the engaged position, and wherein the latch is engageable with the carrier when in the locked position.

30. The fastener driver of claim 1, wherein the lifter assembly moves away from the driver blade when moving from the engaged position to a bypass position.

* * * * *